US006651326B2

(12) United States Patent
Wayman

(10) Patent No.: US 6,651,326 B2
(45) Date of Patent: Nov. 25, 2003

(54) COMPRESSIVE COLLAR

(75) Inventor: Michael J. Wayman, Waconia, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 155 days.

(21) Appl. No.: 09/916,069

(22) Filed: Jul. 26, 2001

(65) Prior Publication Data

US 2002/0146922 A1 Oct. 10, 2002

Related U.S. Application Data

(62) Division of application No. 09/826,577, filed on Apr. 5, 2001, now Pat. No. 6,343,958.

(51) Int. Cl.[7] ..... H01R 43/20

(52) U.S. Cl. ..... 29/876; 29/874; 29/882; 29/884

(58) Field of Search ..... 29/874, 882, 883, 29/884, 876

(56) References Cited

U.S. PATENT DOCUMENTS 2,839,595 A * 6/1958 Felts et al.
3,573,712 A * 4/1971 Shirey
4,026,015 A * 5/1977 Askman et al.
4,046,451 A * 9/1977 Juds et al.
4,059,330 A * 11/1977 Shirey
4,092,396 A * 5/1978 McCartney et al.
4,373,262 A * 2/1983 Blakesley
4,428,639 A * 1/1984 Hillis
4,512,623 A * 4/1985 Tomsa
5,098,310 A * 3/1992 Avramovich et al.
5,383,272 A * 1/1995 Mattingly et al.
5,456,611 A * 10/1995 Henry et al.

* cited by examiner

*Primary Examiner*—Carl J. Arbes
(74) *Attorney, Agent, or Firm*—Fogg and Associates, LLC; Laura A. Ryan

(57) ABSTRACT

A collar is provided that has a sleeve having a tapered axial bore that defines a tapered surface interiorly of the sleeve. The tapered axial bore is adapted to receive a receptacle such that the tapered surface bears against the receptacle. Moreover, the collar has a resilient device that engages the sleeve. The resilient device, the tapered axial bore of the sleeve, and the receptacle receive a connector. Axial displacement of the connector relative to the sleeve and the receptacle compresses the resilient device such that the resilient device exerts an increasing axial force on the sleeve. The increasing axial force displaces the sleeve axially relative to the receptacle causing the tapered surface to exert a radial force on the receptacle.

24 Claims, 4 Drawing Sheets

COMPRESSIVE COLLAR

CROSS REFERENCE TO RELATED CASES

This Application is a divisional of U.S. application Ser. No. 09/826,577 filed Apr. 5, 2001, now U.S. Pat. No. 6,343,958.

TECHNICAL FIELD

The present invention relates generally to the field of electrical connectors and, in particular, to a compressive collar provides improved connections between connectors and receptacles.

BACKGROUND

Connectors are received by receptacles to effect electrical connections in numerous applications. An F-receptacle commonly used to connect antennas, TVs, VCRs, cable modems, and the like to a coaxial cable is one example of a receptacle that is used with a connector (or F-barrel). Receptacles can be twist-on or slip-on. Twist-on receptacles have internal threads and are electrically coupled to connectors by threading the receptacles onto the connectors. Slip-on receptacles are resilient and are electrically coupled to connectors by pressing the connectors into the receptacles. The resiliency of the slip-on receptacle causes the receptacle to bear against the connector, thereby exerting a radial force on the connector.

Electrical couplings formed using twist-on receptacles are usually of better quality than those formed using slip-on receptacles. However, in situations where multiple connections are made, such as in production test fixtures where one receptacle is repetitively connected to a number of connectors or in applications involving a large number of connections, using twist-on receptacles can be time consuming. Electrical couplings formed using slip-on receptacles are usually accomplished more quickly and easily than those using twist-on receptacles.

Unfortunately, in situations where one slip-on receptacle is repetitively connected to one or more connectors, e.g., in production test fixtures, the slip-on connection becomes unreliable due to wear and plastic deformation of the slip-on receptacle after several insertions. For example, in applications involving F-receptacles, wear and plastic deformation can result in unreliable ground connections, which in production test fixtures produces false test results, e.g., false failures, due to loss of ground.

For the reasons stated above, and for other reasons stated below which will become apparent to those skilled in the art upon reading and understanding the present specification, there is a need in the art for improving connections between connectors and receptacles while reducing the wear on the receptacle and the connector and for compensating for wear and plastic deformation in receptacles.

SUMMARY

The above-mentioned problems with wear and plastic deformation of receptacles, the need for improving connections between connectors and receptacles, and other problems are addressed by embodiments of the present invention and will be understood by reading and studying the following specification. Embodiments of the present invention provide a compressive collar that provides improved connections between connectors and receptacles by increasing the contact force between the connector and receptacle while reducing the wear on the connector and receptacle. The collar also compensates for wear and plastic deformation in receptacles that can occur when one receptacle is repetitively connected to one or more connectors, such as in production test fixtures.

More particularly, in one embodiment a collar is provided that has a sleeve having a tapered axial bore that defines a tapered surface interiorly of the sleeve. The tapered axial bore is adapted to receive a receptacle such that the tapered surface bears against the receptacle. Moreover, the collar has a resilient device that engages the sleeve. The resilient device, the axial bore of the sleeve, and the receptacle receive a connector. Axial displacement of the connector relative to the sleeve and the receptacle compresses the resilient device such that the resilient device exerts an increasing axial force on the sleeve. The increasing axial force displaces the sleeve axially relative to the receptacle causing the tapered surface to exert a radial force on the receptacle.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Embodiments of the present invention provide a collar that improves electrical contact between a connector and a receptacle by increasing the contact force between the connector and the receptacle while reducing the wear on the connector and the receptacle. The collar also compensates for wear and plastic deformation in receptacles that can occur when one receptacle is repetitively connected to one or more connectors, such as in production test fixtures.

Figure 1:
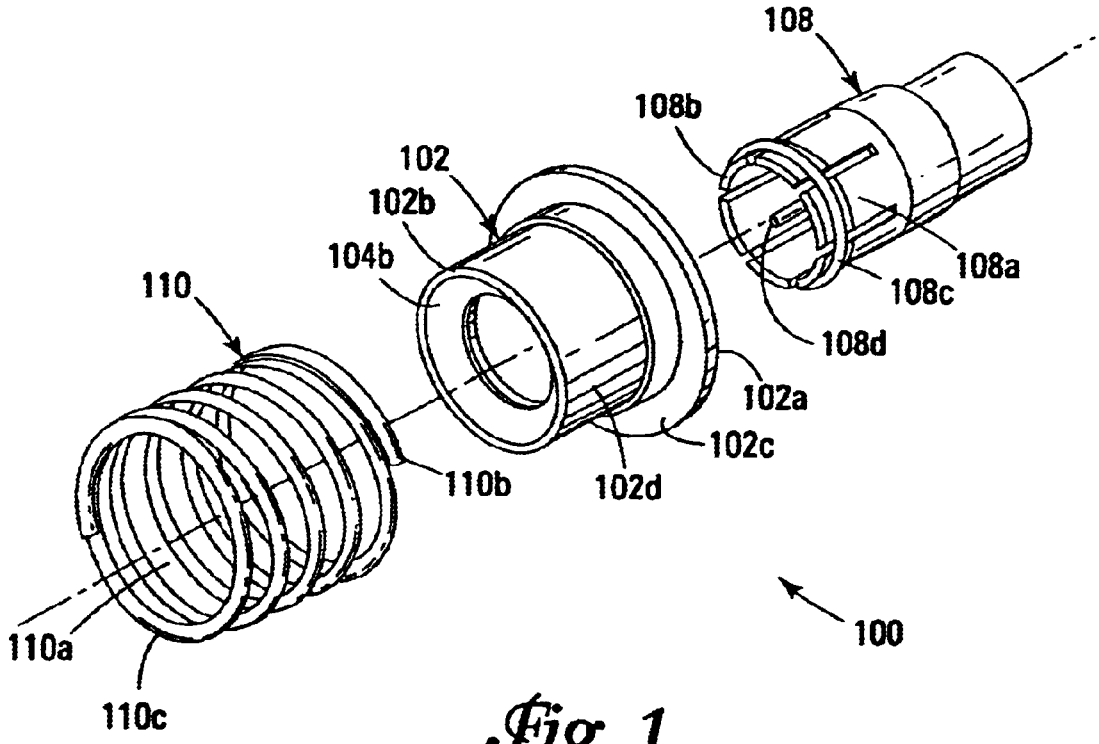
FIG. 1 is an exploded view illustrating an embodiment of the present invention and an exemplary receptacle.
Figure 2:
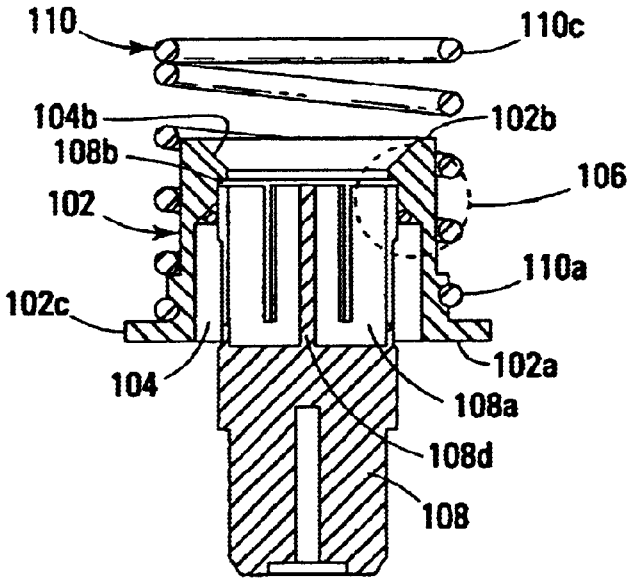
FIG. 2 is a cross-sectional view illustrating an embodiment of the present invention in relation to an exemplary receptacle.
Figure 3:
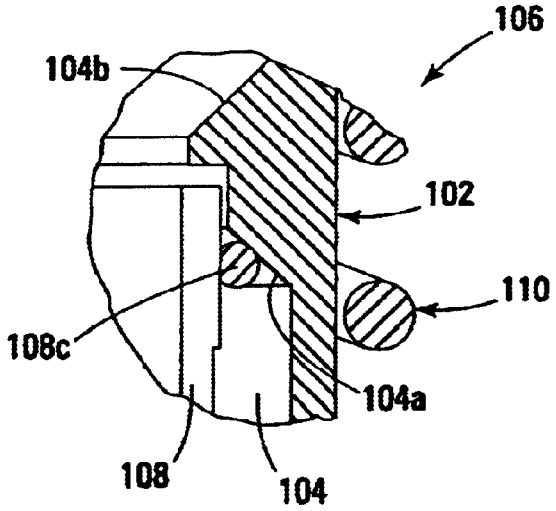
FIG. 3 is an enlarged view of encircled region 106 of FIG. 2.

Collar 100, demonstrated in FIGS. 1–3, is an embodiment of the present invention. Collar 100 includes sleeve 102 that has tapered axial bore 104, as shown in FIGS. 2 and 3. FIG. 3 is an enlarged view of encircled region 106 of FIG. 2. Tapered axial bore 104 passes through ends 102*a* and 102*b* of sleeve 102. Tapered axial bore 104 defines tapered surface 104*a* interiorly of sleeve 102 that tapers toward end 102*b* of sleeve 102, as shown in FIG. 3. Tapered axial bore 104 also defines optional tapered surface 104*b* adjacent end 102*b* of sleeve 102 that tapers toward end 102*a,* as shown in FIGS. 1, 2, and 3. Sleeve 102 can be fabricated from steel, stainless steel, hard plastic, e.g., nylatron, or the like.

Tapered axial bore 104 receives receptacle 108 at end 102*a* of sleeve 102, as shown in FIGS. 1 and 2. The receptacle 108 illustrated in the accompanying figures is referred to as an F-connector by those of ordinary skill in the art. Receptacle 108 is divided into a number of resilient segments 108*a* that extend to end 108*b* of receptacle 108, as shown in FIGS. 1 and 2. Ring 108*c* encircles resilient segments 108*a* adjacent end 108*b*, as shown in FIG. 1. Receptacle 108 also has central conductor 108*d*. When tapered axial bore 104 receives receptacle 108, tapered surface 104*a* bears against ring 108*a* of receptacle 108, as shown in FIG. 3.

Collar 100 includes resilient device 110 that engages sleeve 102. Resilient device 110 engages sleeve 102 by butting against flange 102*c* that is located at end 102*a* of sleeve 102, as shown in FIGS. 1 and 2. More specifically, resilient device 110 has central aperture 110*a*, end 110*b*, and end 110*c*. Central aperture 110*a* of resilient device 110 receives sleeve 102 such that end 110*b* of resilient device 110 is butted against flange 102*c* of sleeve 102 and resilient device 110 is coaxial with sleeve 102, as shown in FIGS. 1 and 2. FIG. 2 shows that in this position, a portion of resilient device 110 extends beyond end 102*b* of sleeve 102 such that end 110*c* of resilient device 110 is displaced axially from end 102*b* of sleeve 102.

In the embodiment illustrated in the accompanying figures, resilient device 110 is a coil spring. The coil spring can be music wire, e.g., ASTM-A228 or AMS 5112, stainless steel, e.g., 302 series, or the like. In another embodiment, resilient device 110 is a resilient tube, e.g., a rubber tube, elastomeric tube, or the like. In other embodiments, flange 102*c* is located between ends 102*a* and 102*b* of sleeve 102. In another embodiment, resilient device 110 engages sleeve 102 by being attached to outer surface 102*d* of sleeve 102. Attachment of resilient device 110 to outer surface 102*d* can be accomplished by welding, gluing, using screw-on clamps, or the like.

Figure 4:
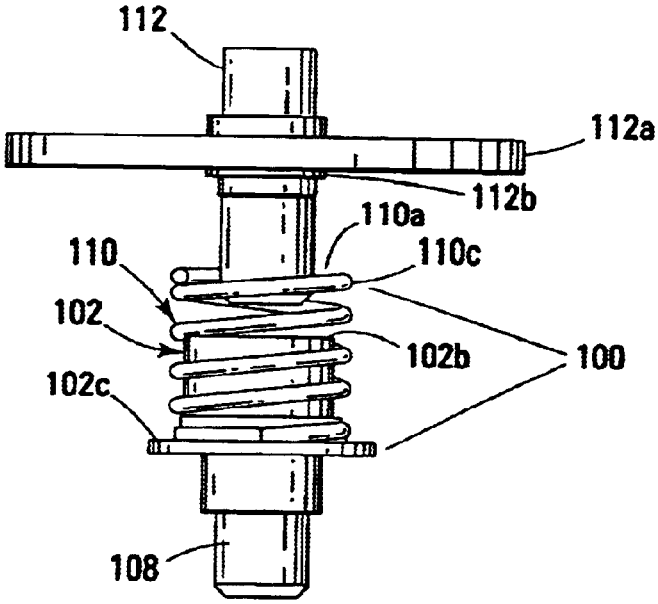
FIGS. 4 through 7 illustrate an embodiment of a method for improving the contact between a receptacle and a connector.
Figure 5:
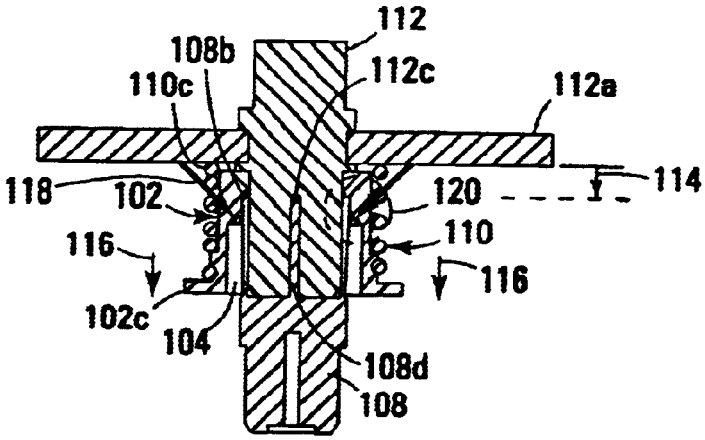

Central aperture 110*a* of resilient device 110, tapered axial bore 104 of sleeve 102, and receptacle 108 receive connector 112 sequentially at end 110*c* of resilient device 110, end 102*b* of sleeve 102, and end 108*b* of receptacle 108, as shown in FIGS. 4 and 5. The connector 112 illustrated in FIGS. 4 and 5 is referred to as an F-barrel by those ordinarily skilled in the art.

Figure 7:
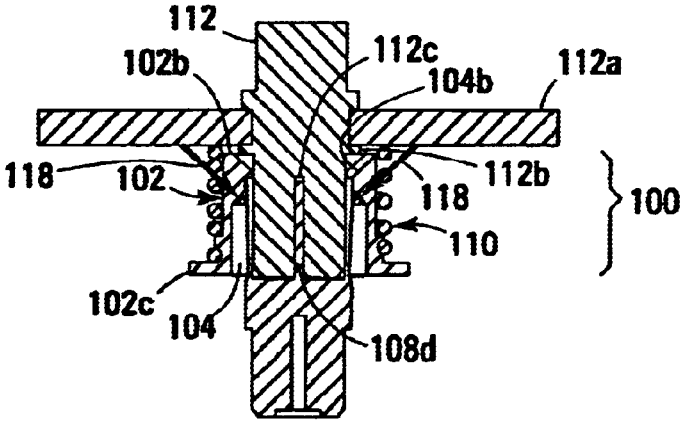

Connector 112 has flange 112*a* that extends radially from the connector. Flange 112*a* has step 112*b* that protrudes axially from flange 112*a*, as shown in FIG. 4. Step 112*b* is received by tapered surface 104*b* of sleeve 102, as shown in FIG. 7. Connector 112 also has a hollow core 112*c* for receiving central conductor 108*d* of receptacle 108, as shown in FIG. 7. When connector 112 is received by central aperture 110*a* of resilient device 110, tapered axial bore 104 of sleeve 102, and receptacle 108, connector 112 extends into receptacle 108 and flange 112*a* butts against end 110*c* of resilient device 110, as shown in FIG. 5.

Figure 6:
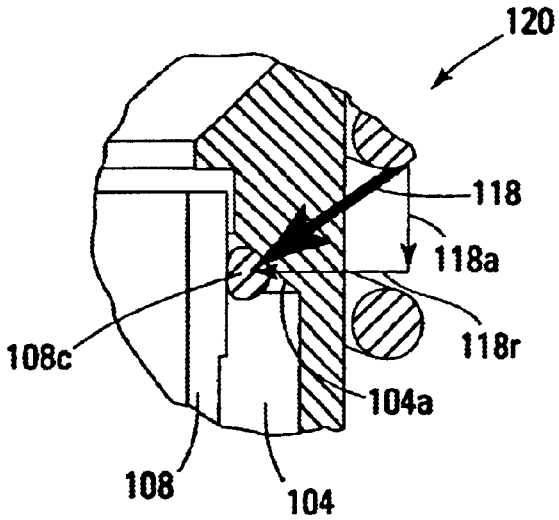

Axial displacement, as indicated by arrow 114 of FIG. 5, of connector 112 relative to sleeve 102 and receptacle 108 causes flange 112*a* of connector 112 to compress resilient device 110. Compression of resilient device 110 exerts an increasing axial force on flange 102*c* of sleeve 102, which axial force is indicated by arrows 116 of FIG. 5. The axial force displaces sleeve 102 axially relative to receptacle 108. This causes tapered surface 104*a* to exert a force on ring 108*c* of receptacle 108, which force is indicated by arrows 118 of FIGS. 5 and 6. FIG. 6 is an enlarged view of encircled region 120 of FIG. 5.

FIG. 6 shows that the force exerted on ring 108*c* of receptacle 108 includes an axial component and a radial component, which components are respectively indicated by arrows 118*a* and 118*r*. As the axial force exerted by resilient device 110 on flange 102*c* increases, the radial and axial components of the force exerted on ring 108*c* increase.

In use, tapered axial bore 104 of sleeve 102 of collar 100 receives receptacle 108 at end 102*a* of sleeve 102 such that tapered surface 104*a* of sleeve 102 bears against ring 108*c*, as shown in FIGS. 2 and 3. In addition, central aperture 110*a* of resilient device 110, tapered axial bore 104 of sleeve 102, and receptacle 108 receive connector 112 sequentially at end 110*c* of resilient device 110, end 102*b* of sleeve 102, and end 108*b* of receptacle 108, as shown in FIGS. 4 and 5.

As connector 112 is received at end 108*b* of receptacle 108, resilient segments 108*a* are deflected by connector 112 and exert a radial force on connector 112. Connector 112 is received by central aperture 110*a*, tapered axial bore 104, and receptacle 108 until flange 112*a* of connector 112 butts against end 110*c* of resilient device 110, as shown in FIG. 5. In this position, connector 112 extends into receptacle 108, and resilient segments 108*a* exert a radial contact force on connector 112.

Connector 112 is now displaced axially relative to sleeve 102 and receptacle 108, as indicated by arrow 114 of FIG. 5. This causes flange 112*a* of connector 112 to compress resilient device 110. As resilient device 110 is compressed, resilient device 110 exerts an increasing axial force on flange 102*c*, as indicated by arrows 116 of FIG. 5. The increasing axial force displaces sleeve 102 axially relative to receptacle 108. This causes tapered surface 104*a* to impart a force to ring 108*c* of receptacle 108, as indicated by arrows 118 of FIGS. 5 and 6. The radial component of the force imparted to ring 108*c*, indicated by arrow 118*r* in FIG. 5, exerts a radial contact force on connector 112 in addition to the radial contact force exerted by resilient segments 108*a*.

Displacement of connector 112 continues until flange 112*a* of connector 112 butts against end 102*b* of sleeve 102 and hollow core 112*c* of connector 112 receives central conductor 108*d* of receptacle 108, as shown in FIG. 7. In the configuration of FIG. 7, the radial component of the force indicated by arrows 118 increases the contact between receptacle 108 and connector 112, thereby providing a more reliable connection. Moreover, the radial component of the force indicated by arrows 118 compensates for the wear and plastic deformation of receptacle 108 that can occur after receptacle 108 receives repetitively a number of connectors 112, such as occurs in production test fixtures.

The radial force indicated by arrow 118*r* increases as connector 112 is displaced axially in that the axial force exerted by resilient device 110 on flange 102*c* increases as connector 112 is displaced. Therefore, the radial contact force at the early stages of the displacement is considerably lower than at the later stages. This reduces the wear on connector 112 and receptacle 108 in that the largest radial contact forces are only exerted during the later stages of displacement, which is only a fraction of the total displacement.

CONCLUSION

Embodiments of the present invention have been described. The embodiments provide a collar that improves electrical contact between a connector and a receptacle by increasing the contact force between the connector and the receptacle while reducing the wear on the connector and the receptacle. The collar also compensates for wear and plastic deformation in receptacles that can occur when one receptacle is repetitively connected to one or more connectors, such as in production test fixtures.

The collar has a sleeve having a tapered axial bore that defines a tapered surface interiorly of the sleeve. The tapered axial bore is adapted to receive the receptacle such that the tapered surface bears against the receptacle. Moreover, the collar has a resilient device that engages the sleeve. The resilient device, the axial bore of the sleeve, and the receptacle receive the connector. Axial displacement of the connector relative to the sleeve and the receptacle compresses the resilient device such that the resilient device exerts an increasing axial force on the sleeve. The increasing axial force displaces the sleeve axially relative to the receptacle causing the tapered surface to exert a radial force on the receptacle.

Although specific embodiments have been illustrated and described in this specification, it will be appreciated by those of ordinary skill in the art that any arrangement that is calculated to achieve the same purpose may be substituted for the specific embodiment shown. This application is intended to cover any adaptations or variations of the present invention. For example, embodiments of the present invention are not limited to F-connectors and F-barrels that respectively exemplify receptacle 108 and connector 112. Rather the present invention can be used with receptacles that do not have resilient segments 108*a*, rings 108*c*, and/or central conductor 108*d*. Moreover, embodiments of the present invention can be used with connectors that do not have step 112*b* that protrudes axially from flange 112*a* and/or hollow core 112*c*.

What is claimed is:

1. A method for improving the contact between a receptacle and a connector, the method comprising:

receiving the connector in the receptacle;

displacing the connector axially relative to the receptacle; and exerting a radial inward force on the exterior of the receptacle that increases with displace the connector.

2. The method of claim 1, wherein displacing the connector axially produces an axial force that increases with displacing the connector.

3. The method of claim 2, further comprising converting the axial force into the radial inward force using a tapered surface.

4. The method of claim 1, further comprising receiving the receptacle in a tapered bore defining tapered surface interiorly of a sleeve before receiving the connector in the receptacle such that the receptacle bears against the tapered surface.

5. The method of claim 3, wherein converting axial force into a radial inward force comprises the tapered surface bearing against an exterior of the receptacle.

6. The method of claim 1, wherein displacing the connector axially comprises buffing the connector against a resilient device.

7. The method of claim 6, further comprising compressing the resilient device using the connector.

8. The method of claim 1, wherein receiving the connector comprises the connector deflecting a plurality of resilient segments of the connector so that the resilient segments exert a radial force on the connector.

9. The method of claim 8, wherein exerting the radial inward force comprises exerting the radial inward force on the resilient segments.

10. The method of claim 8, wherein exerting the radial inward forces comprises exerting the radial inward force on a ring that encircles the resilient segments.

11. The method of claim 1, wherein receiving the connector comprises a hollow core of the connector receiving a central conductor of the receptacle.

12. A method for improving the contact between a receptacle and a connector, the method comprising:

receiving the connector in the receptacle;

displacing the connector axially relative to the receptacle;

producing an axial force that increases with displacing the connector;

converting the axial force into a radial inward force; and exerting the radial inward force on the exterior of the receptacle that increases with displacing the connector.

13. The method of claim 12, wherein producing an axial force is accomplished using a resilient device.

14. The method of claim 12, wherein converting the axial force into a radial inward force is accomplished using a tapered surface that bears against an exterior of the receptacle.

15. The method of claim 12, further comprising receiving the receptacle in a tapered bore defining a tapered surface interiorly of a sleeve before receiving the connector in the receptacle such that the receptacle bears against the tapered surface.

16. The method of claim 12, wherein displacing the connector axially comprises butting a flange of the connector against a resilient device and compressing the resilient device using thc connector.

17. The method of claim 12, wherein exerting the radial inward force comprises exerting the radial inward force on a ring that encircles a plurality of resilient segments of the connector.

18. The method of claim 12, wherein receiving the connector comprises hollow core of the connector receiving a central conductor of the receptacle.

19. A method for improving the contact between a receptacle and a connector, the method comprising:

receiving the receptacle in a tapered bore that defines a tapered surface interiorly of a sleeve such tat the receptacle bears against the tapered surface;

receiving the connector sequentially in a resilient device, the tapered bore, and the receptacle;

displacing the connector axially relative to the receptacle and the sleeve;

producing an axial force that increases with displacing the connector using the displacement of the connector to compress the resilient device; exerting the axial force on the sleeve;

converting the axial force into a radial inward force by displacing the sleeve axially relative to the receptacle using the axial force such that tapered surface bears against the exterior of the receptacle; and exerting the radial inward force on the exterior of the receptacle that increases with displacing the connector.

20. The method of claim 19, wherein receiving the connector comprises a hollow core of the connector receiving a central conductor of the receptacle.

21. The method of claim 19, wherein receiving the connector comprises the connector deflecting a plurality of resilient segments of the connector so that the resilient segments exert a radial force on the connector.

22. The method of claim 21, wherein exerting the radial inward force comprises exerting the radial inward force on the resilient segments.

23. The method of claim 19, wherein displacing the connector axially comprises butting the connector against the resilient device.

24. The method of claim 19, further comprising continuing the displacement of the connector until a flange of the connector butts against an end of the sleeve.

* * * * *